United States Patent [19]

Riehl et al.

[11] Patent Number: 4,646,762

[45] Date of Patent: Mar. 3, 1987

[54] CIGARETTE HAVING A MOUTHPIECE

[75] Inventors: Tilford F. Riehl; Robert R. Johnson, both of Louisville, Ky.

[73] Assignee: Brown & Williamson Tobacco Corporation, Louisville, Ky.

[21] Appl. No.: 558,219

[22] Filed: Dec. 5, 1983

[51] Int. Cl.[4] ..... A24D 3/04

[52] U.S. Cl. ..... 131/336; 131/339; 131/340

[58] Field of Search ..... 131/336, 339, 340

[56] References Cited

U.S. PATENT DOCUMENTS 3,490,461 1/1970 Osmalov et al. ..... 131/336

FOREIGN PATENT DOCUMENTS 1531543 5/1968 France ..... 131/336

*Primary Examiner*—V. Millin

*Attorney, Agent, or Firm*—Charles G. Lamb

[57] ABSTRACT

A smoking article, such as a cigarette, includes, in one advantageous embodiment, a generally cylindrical, hollow tubular mouth section located in coaxial abutment to one end of the tobacco column of the cigarette. The wall of the mouth section is fabricated of an impermeable material. A plurality of grooves are formed in the periphery of the mouth section extending generally longitudinally thereof and being open to at least the mouth end of the mouth section. Air permeable tipping material circumferentially surrounds the mouth section and overlaps a portion of the tobacco column adjacent the mouth section. In a further embodiment of the present invention as discussed above, the tobacco column is two coaxially located tobacco sections with the tobacco section interfacing with the mouth section being of a different density than the other tobacco section. In yet a further embodiment of the present invention, the generally cylindrical, hollow tubular mouth section is formed with flow channels through the mouth section. Ventilation air openings are formed through the wall of the mouth section to provide for the flow of ventilating air into some of the flow channels. Air permeable tipping material circumferentially surrounds the mouth section and overlaps a portion of the tobacco column adjacent the mouth section, the grooves are organized into a plurality of groups, each group including a plurality of grooves to provide for the flow of ventilating air therethrough and through the ventilation air openings of the mouth section into the flow channels.

16 Claims, 8 Drawing Figures

CIGARETTE HAVING A MOUTHPIECE

BACKGROUND OF THE INVENTION

1. Field of the Invention

The present invention relates to smoke diluting devices, and more particularly to a mouthpiece for a cigarette, or the like, which reduces tar exclusively by ventilation.

2. Description of the Prior Art

It is well known in the art to add filters to cigarettes wherein the filters are provided with ventilating means to bring ambient air into the filter to dilute the smoke flowing through the filter. The dilution of the smoke reduces the quantity of smoke particulates as well as gas phase components which are delivered to the mouth of the smoker.

Another method for diluting the smoke is to make the tobacco column wrapper material permeable to air which allows for the introduction of air along the entire length of the tobacco column where it mixes with the smoke stream passing through the tobacco column thereby diluting the smoke.

Yet another method is to provide generally longitudinal ventilation air grooves in the periphery of a filter which grooves are open to the mouth end of the filter. The filtered smoke leaving the mouth end of the filter is mixed with the ventilation air exiting the ventilation air grooves to the smoker's mouth whereat the smoke is diluted. Examples of cigarette filters having grooves for the introduction of ventilating air into the filtering end are shown in the following patents: U.S. Pat. No. 3,577,995; U.S. Pat. No. 3,572,347; U.S. Pat. No. 3,490,461; U.S. Pat. No. 1,718,122; U.S. Pat. No. 3,788,330; U.S. Pat. No. 3,773,053; U.S. Pat. No. 3,752,165; U.S. Pat. No. 3,638,661; U.S. Pat. No. 3,608,561; U.S. Pat. No. 3,910,288; and U.S. Pat. No. 4,256,122.

It has also been proposed to provide a cigarette filter which delivers a combination of air diluted filtered smoke and undiluted, unfiltered smoke to the smoker's mouth. One such cigarette filter is shown in U.S. Pat. No. 3,860,011 as being formed of a hollow filter including a rigid non-deformable tube defining a smoke passage for delivering unfiltered smoke to the smoker's mouth, a concentric layer of filter material surrounding the tube, and a perforated outer wrap for the passage of air into the layer of filter material.

Devices for diluting unfiltered smoke with ventilating air before the smoke enters a smoker's mouth are also known. One example of such a device is shown in U.S. Pat. No. 3,552,399. The device, therein referred to as a filter for homogenizing air and smoke has a blind ended, longitudinal central axial passageway open to either the smoker's mouth or a filter element, a plurality of longitudinal passageways, and transverse passageways interconnecting the longitudinal passageways and central passageways with each other and with the ambient air. As the cigarette to which the device is attached is smoked, smoke and ambient air traverse the longitudinal and central passageways wherein the smoke and air are mixed before delivery to the smoker's mouth.

Devices are also known for delivering unfiltered smoke and ventilation air to the smoker's mouth. For example, U.S. Pat. No. 4,023,576 teaches a cigarette with a hollow mouthpiece which defines a smoke chamber. The smoke chamber is separated from the tobacco column by two spaced apart baffle plates which define a curved path which the smoke must traverse before entering the smoke chamber. The mouth end of the chamber is closed by a wall having a central orifice for the flow of smoke out of the smoke chamber into the smoker's mouth. The exterior surface of the mouthpiece is provided with longitudinal grooves which cooperate with an overlaying perforated tipping paper to define flow paths for ventilating air. When a smoker draws on the mouthpiece, undiluted, unfiltered smoke is drawn from the tobacco column into the smoke chamber and through the outlet orifice centrally of the mouthpiece and into the smoker's mouth. At the same time, ventilation air is drawn in through the tipping paper and longitudinal grooves to mix with the undiluted smoke within the smoker's mouth.

SUMMARY OF THE INVENTION

The present invention advantageously provides a straightforward arrangement of a hollow tubular mouth section for a cigarette for lowering tar exclusively by ventilation using ambient air.

More particularly, the present invention provides a cigarette comprising a generally cylindrically shaped tobacco column; a generally cylindrically shaped, hollow tubular mouth section located in coaxial abutment to one end of the tobacco column, the wall of the mouth section being impermeable; a plurality of grooves formed in the periphery of mouth section extending generally longitudinally of the tubular mouth section and being open to at least the mouth end of the mouth section; and tipping material circumferentially surrounding the mouth section and overlapping a portion of the tobacco column adjacent the mouth section, the tipping material being permeable over an area of each of the grooves.

Further, the present invention includes a first generally cylindrically shaped tobacco section interfacing with the mouth section; a second generally cylindrically shaped tobacco section; and the density of the first tobacco section being different than the density of the second tobacco section.

BRIEF DESCRIPTION OF THE DRAWINGS

The various features and advantages of the present invention will become even more clear upon reference to the following description and accompanying drawings wherein like numerals refer to like parts throughout, and in which.

DETAILED DESCRIPTION OF THE PREFERRED EMBODIMENTS

Figure 1:
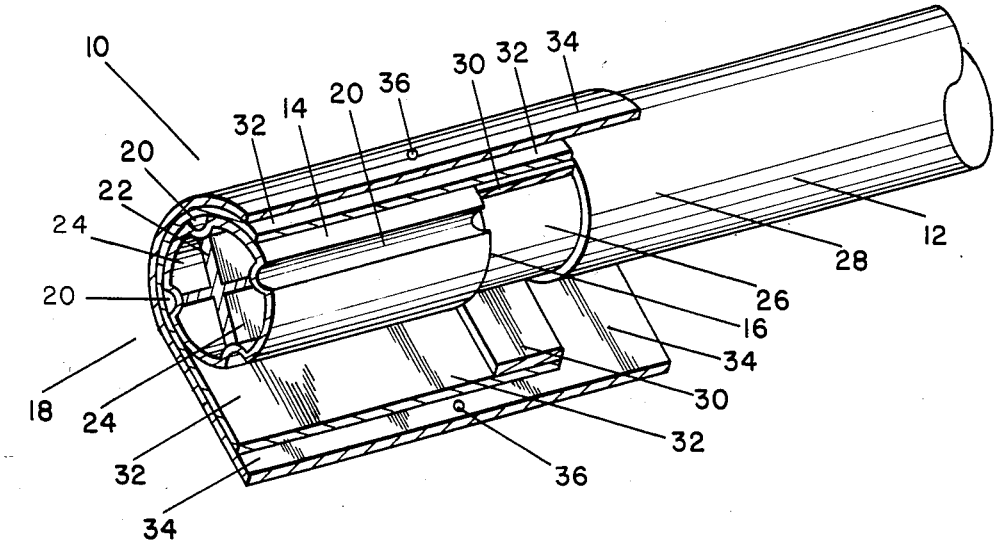
FIG. 1 is a perspective view of a cigarette including one advantageous embodiment of the present invention, the tipping material being illustrated as partially unwound to more clearly show details.
Figure 2:
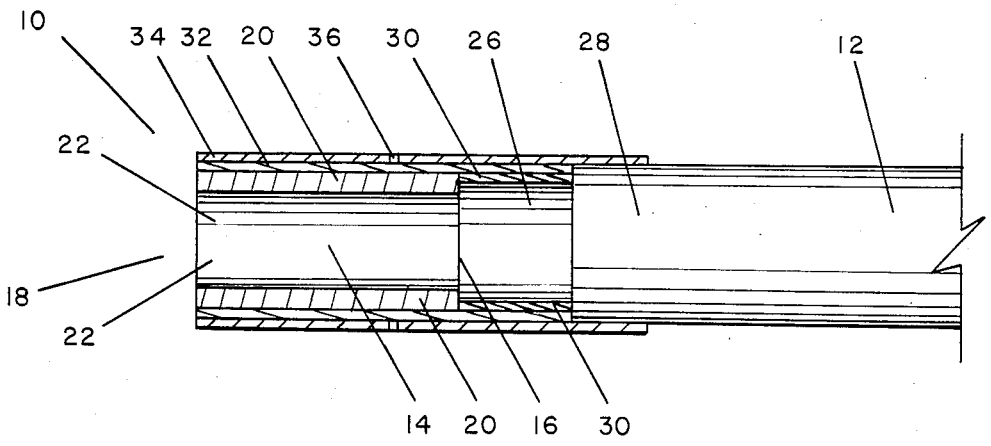
FIG. 2 is a longitudinal cross-sectional view of the cigarette of FIG. 1.

FIGS. 1 and 2 show one advantageous embodiment of a mouthpiece of the present invention, generally denoted as the numeral 10, attached to a cigarette tobacco column 12.

The mouthpiece 10 is shown as including a generally cylindrically shaped, hollow mouth section 14 having a smoke inlet end 16 and an outlet or mouth end 18. The mouth section 14 is fabricated of an air and smoke impermeable material such as, for example, an extruded plastic. The mouth section 14 is coaxially located at one end of the tobacco column 12 with the inlet end 16 in juxtaposition to the end of the tobacco column 12. The mouth section 14 is formed with a plurality of grooves 20 in its peripheral surface extending generally longitudinally of the mouth section 14 from the inlet end 16 to the mouth end 20. The grooves 20 are shown as being four in number and are equally spaced apart circumferentially of the mouth section 14. The mouth section 14 also includes webs 22 equal in number to the number of grooves 20. As illustrated, each of the webs 22 extends from a different one of the grooves 20 generally radially of the transverse cross-section of the mouth section 14 and join together at the longitudinal centerline of the mouth section 14. The webs 22 also extend the entire length of the mouth section 14. The webs 22 cooperate with the interior wall surface of the mouth section to define four smoke flow channels 24 which are open to both ends 16 and 18 of the mouth section 14.

The cigarette tobacco column 12 of the present invention may further comprise two tobacco sections, a first generally cylindrical tobacco section 26 at the end of the tobacco column interfacing with the mouth section 14, and a second generally cylindrical section 28 in coaxial abutment with the first tobacco section 26. The first tobacco section 26 is of a different density than the second section 28 and is substantially shorter in length. The second tobacco section 28 is that portion of the tobacco column 12 which will be smoked. The density of the first tobacco section 26 may be determined to provide a higher or lower pressure drop thereacross than the pressure drop provided by the second tobacco section 28. The pressure drop across the first tobacco section 26 can be selected to, for example, provide a draw effort similar to that of a filtered cigarette. Further, the first tobacco section 26 provides for a substantially constant draw effort as the second tobacco section 28 is smoked.

As shown in FIGS. 1 and 2, a non-porous wrapper 30 circumscribes the first tobacco section 26 to prevent the flow of air into and the flow smoke out of the first tobacco section 26 through its periphery. A porous plug wrap 32 circumscribes both the mouth section 14 and first tobacco section 26 securing them together. The mouthpiece 10 is attached to the second tobacco section 28 by an air permeable tipping material 34 which circumscribes the mouthpiece 10 and overlaps a portion of the second tobacco section 28. At least a portion of the tipping material 34 surrounding the mouth section 14 is air permeable at least over a portion of the grooves 20. The tipping material 34 can be fabricated of a porous material, or as shown, be made air permeable by forming small perforations 36 through the thickness of the tipping material 34.

Figure 3:
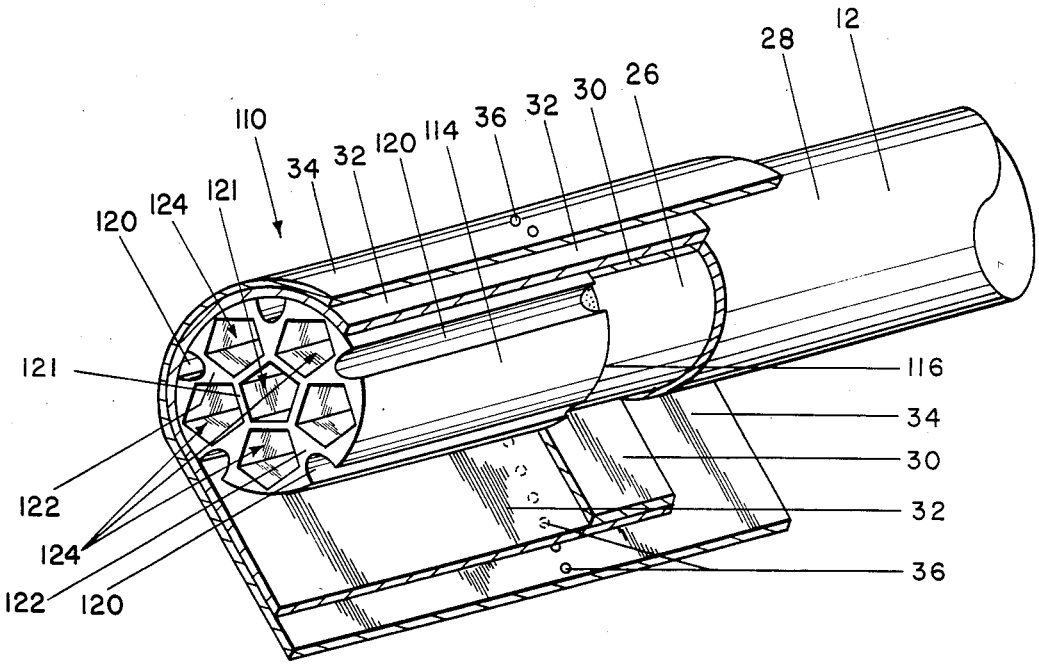
FIG. 3 is a perspective view of a cigarette including another advantageous embodiment of the present invention, the tipping material being illustrated as partially unwound to more clearly show details.
Figure 4:
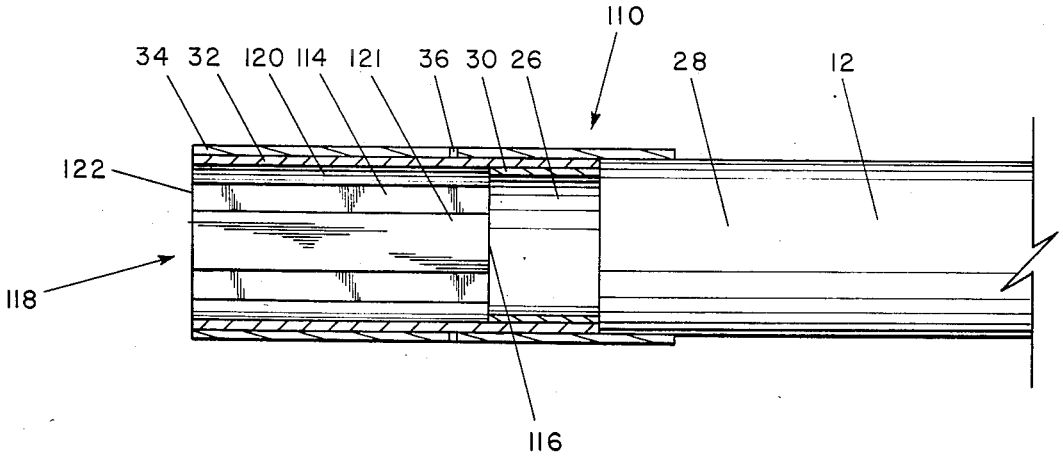
FIG. 4 is a longitudinal cross-sectional view of the cigarette of FIG. 3.

FIGS. 3 and 4 show another advantageous embodiment of a mouthpiece of the present invention, generally denoted by the numeral 110, attached to the tobacco column 12. The mouthpiece 110 includes a generally cylindrically shaped, hollow mouth section 114 having a smoke inlet end 116 and an outlet or mouth end 118. The mouth section 114 is fabricated of an air and smoke impermeable material such as, for example, an extruded plastic. The mouth section 114 is coaxially located at one end of the tobacco column 12 with its inlet end 116 in juxtaposition to the end of the tobacco column 12. The mouth section 114 is formed with five grooves 120 in its peripheral surface extending generally longitudinally of the mouth section 114 from the inlet end 116 to the mouth end 118. The grooves 120 are equally spaced apart circumferentially of the mouth section 114. The mouth section 114 also includes a hollow elongated core member 121 concentrically located within the mouth section 114 and extending the entire length of mouth section 114 defining a central smoke flow channel down the center of the mouth section 114. The transverse cross-section of the core member 121 is in the shape of a pentagon and is oriented with each apex of its pentagonal shape in general alignment with a different one of the grooves 120 along a radius of the transverse cross-section of the mouth section 114. In addition, webs 122 extend from each groove 120 generally radially of the mouth section 114 to a different one of the apexes of the pentagonal shaped core member 121. The webs 122 also extend the entire length of the mouth section 114. The webs 122 cooperate with the interior wall surface of the mouth section 114 and the walls of the core member 121 to define five smoke flow channels 124, in addition to the smoke flow channel defined by the hollow core member 121, which are open to both ends 116 and 118 of the mouth section 114.

As with the embodiment of FIGS. 1 and 2, the cigarette tobacco column 12 includes the first tobacco section 26 and second tobacco section 28. The first tobacco section 26 is circumscribed by the non-porous wrap 30, the porous plug wrap 32 circumscribes both the mouth section 114 and first tobacco section 26, and the mouthpiece 110 is attached to the tobacco column 12 by the air permeable tipping material 34 as fully discussed in regard to the mouthpiece 10.

In the embodiments of FIGS. 1–4, as the smoker draws on the cigarette, unfiltered smoke passes through the smoke channels and into the smoker's mouth while essentially only ventilation air is drawn into the grooves and passes along the grooves into the smoker's mouth. The unfiltered smoke and ventilating air comingle in the smoker's mouth where the smoke is substantially diluted.

Figure 5:
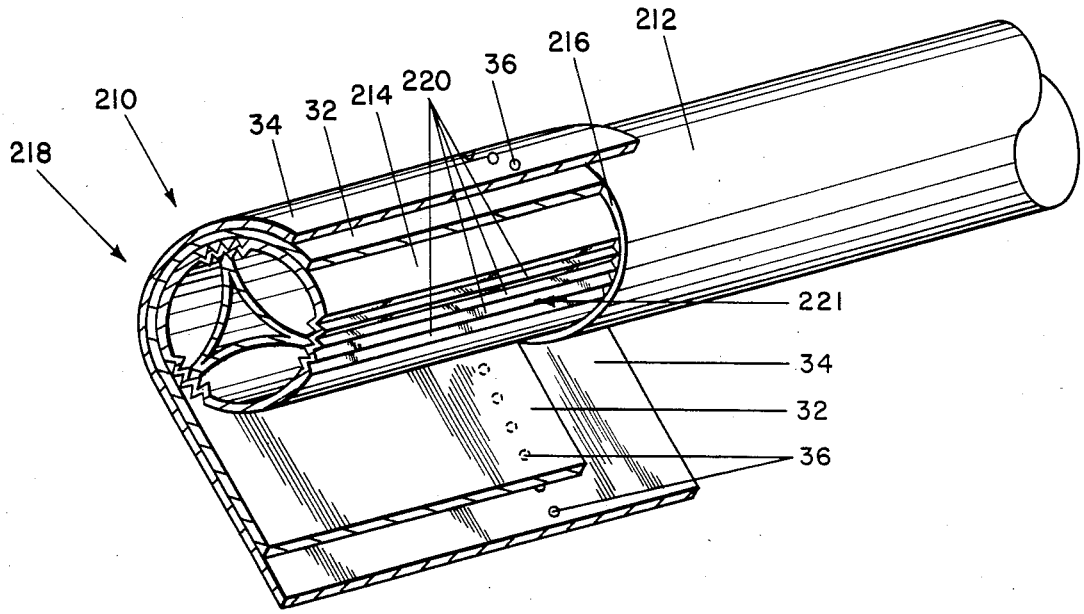
FIG. 5 is a perspective view of a cigarette including a further advantageous embodiment of the present invention, the tipping material being illustrated as partially unwound to more clearly show details.
Figure 6:
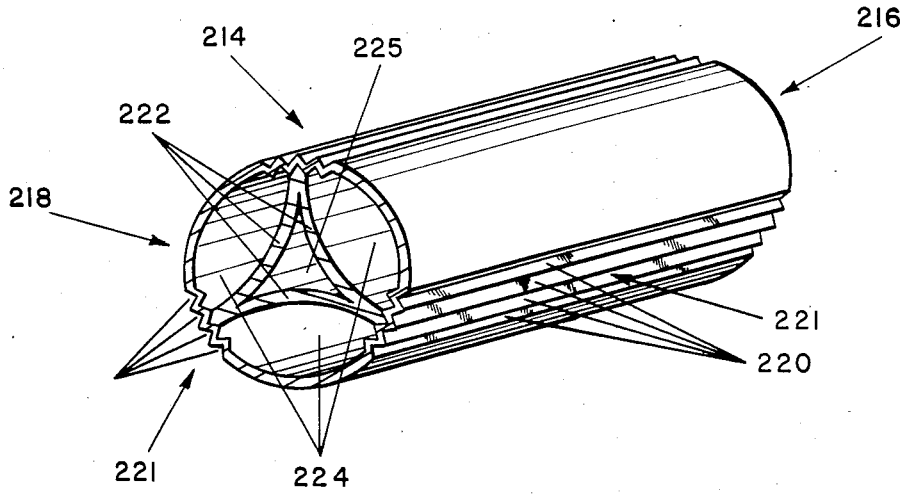
FIG. 6 is a perspective view of the mouthpiece of the cigarette of FIG. 5.

FIGS. 5 and 6 show still a further embodiment of a mouthpiece of the present invention, generally denoted by the numeral 210, attached to the cigarette tobacco column 212.

The mouthpiece 210 is illustrated as including a generally cylindrically shaped, hollow mouth section 214 having a smoke inlet end 216 and an outlet or mouth end 218. The mouth section 214 is fabricated of an air and smoke impermeable material such as, for example, an extruded plastic. The mouth section 214 is coaxially located at one end of the tobacco column 12 with the inlet end 216 in juxtaposition to the end of the tobacco column 12. The mouth section 214 is formed with a plurality of grooves 220, arranged in groups 221, in its peripheral surface. Each group 221 includes a plurality of grooves 220 extending generally longitudinally of the mouth section 214 from the inlet end 216 to the mouth end 218. As illustrated, there are three groups 221 of grooves 220 equally spaced apart around the circumference of the mouth section 214, and each group 221 is made up of four grooves 220 located immediately adjacent and in parallel disposition to each other. The mouth section 214 includes webs 222 each spanning, generally, a different chord of the transverse cross-section of the mouth section 214 and extending the entire length of the mouth section 214. As shown, there are three such webs 222 spaced at equal intervals around the interior of the mouth section 214. The webs 222 cooperate with the interior wall surface of the mouth section 214 to define three smoke flow channels 224 which are open to both ends 216 and 218 of the mouth section 214. Further, the webs 222 mutually cooperate to define a central smoke channel 225 coaxial with the longitudinal centerline of the mouth section 214 and open to both ends 216 and 218 of the mouth section 214. The central channel 225 is surrounded by the other channels 224.

The porous plug wrap 32 circumscribes the mouth section 214 and the mouth section 214 is attached to the tobacco column 212 by the air permeable tipping material 34 which overlaps a portion of the tobacco column 212 adjacent the mouth section 214.

In the embodiment of FIGS. 5–6, as the smoker draws on the mouthpiece 210, unfiltered smoke passes through the central channel 225 and surrounding channels 224 and into the smoker's mouth while essentially only ventilating air is drawn into the grooves 220 and passes along the grooves into the smoker's mouth. The unfiltered smoke and ventilating air comingle in the smoker's mouth where the smoke is substantially diluted.

Figure 7:
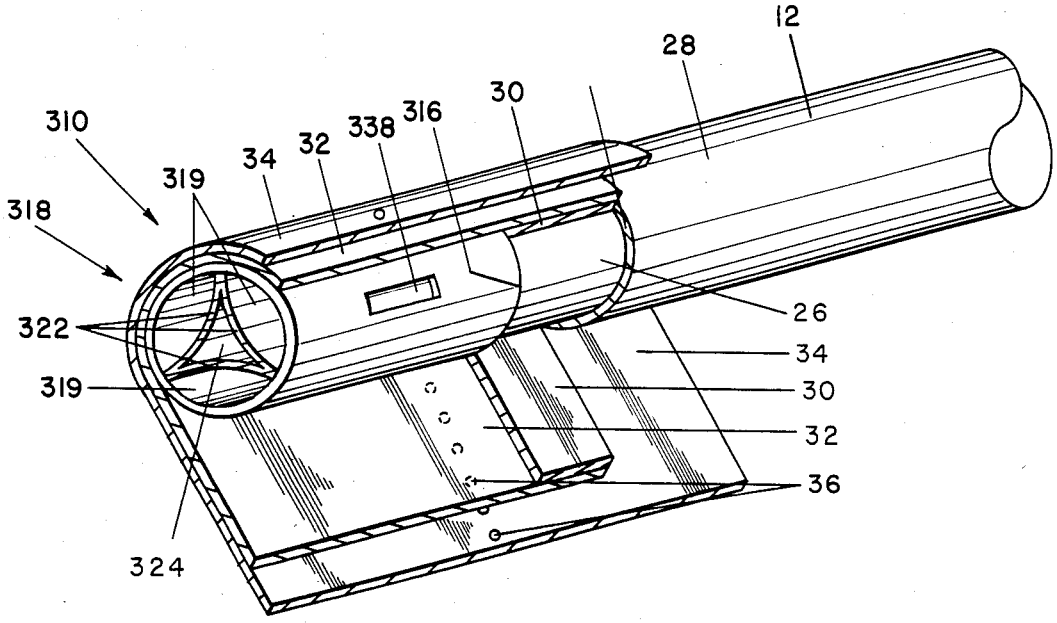
FIG. 7 is a perspective view of a cigarette including still a further advantageous embodiment of the present invention, the tipping material being illustrated as partially unwound to more clearly show details.
Figure 8:
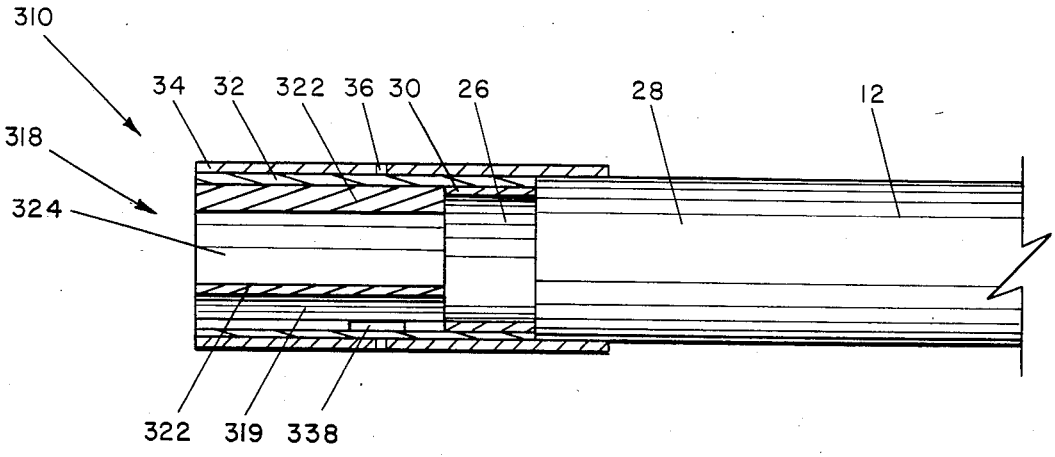
FIG. 8 is a longitudinal cross-sectional view of the cigarette of FIG. 7.

With reference to FIGS. 7 and 8, yet another embodiment of a mouthpiece of the present invention, generally denoted by the numeral 310, attached to the cigarette tobacco column 12.

The mouthpiece 310 is shown as including a generally cylindrically shaped hollow mouth section 314 having a smoke inlet end 316 and an outlet or mouth end 318. The mouth section 314 is fabricated of an air and smoke impermeable material such as, for example, an extruded plastic. The mouth section 314 is coaxially located at one end of the tobacco column 12 with the inlet end 316 in juxtaposition to the end of the tobacco column 12. The mouth section 314 includes a plurality of webs 322 which are illustrated as spanning generally different chords of the transverse cross-section of the mouth section 314. As shown, there are three such webs 322 spaced at equal intervals around the interior of the mouth section 314. Each web 322 cooperates with the interior wall surface of the mouth section 314 to define air-smoke flow channels 319 which are each open at both ends 316 and 318 of the mouth section 314. In addition, the webs 322 mutually cooperate to define a central smoke flow channel 324 concentric with the mouth section 314 and also open to both ends 316 and 318 of the mouth section 314 and surrounded by the channels 319. At least a portion of the wall of the mouth section 314 is removed to define a ventilating air slot 338 open to each of the air-smoke channels 319 between the ends 316 and 318 of the mouth section 314.

As in the embodiments of FIGS. 1–6, the cigarette tobacco column 12 includes the first tobacco section 26 and second tobacco section 28. The first tobacco section is circumscribed by the non-porous wrap 30, the porous wrap 32 circumscribes both the mouth section 314 and first tobacco section 26, and the mouthpiece 310 is attached to the tobacco column 12 by the air permeable tipping material 34 as fully discussed in regard to the mouthpiece 10. In the embodiment of FIGS. 7 and 8, the air permeable tipping material is air permeable at least over the slots 338 through the wall of the mouth section 314.

In the embodiment of FIGS. 7–8, as the smoker draws on the cigarette, unfiltered, undiluted smoke passes through the central smoke channel 324 and into the smoker's mouth while a comingled mixture of air and smoke passes along the channels 319 into the smoker's mouth.

The foregoing detailed description is given primarily for clearness of understanding and no unnecessary limitations should be understood therefrom for modifications will become obvious to those skilled in the art upon reading this disclosure and may be made without departing from the spirit of the invention or scope of the appended claims.

What is claimed is:

1. A cigarette comprising:

a generally cylindrically shaped tobacco column;

a generally cylindrically shaped, hollow tubular mouth section located in coaxial abutment to one end of the tobacco column, the wall of the mouth section being impermeable;

a plurality of grooves formed in the periphery of the mouth section extending generally longitudinally of the tubular mouth section and being open to at least the mouth end of the mouth section; the grooves are organized into a plurality of groups wherein each group is distinct and separated from said other group, each group including a plurality of grooves; and, tipping material circumferentially surrounding the mouth section and overlapping a portion of the tobacco column adjacent the mouth section, the tipping material being permeable over an area of each of the grooves.

2. The cigarette of claim 1, further comprising permeable wrapping material circumferentially surrounding the mouth section, and the tipping material overlaying the wrapper material.

3. The cigarette of claim 1, wherein the grooves are open to both ends of the mouth section.

4. The cigarette of claim 1, wherein the groups are generally equally spaced apart circumferentially of the mouth section.

5. The cigarette of claim 1, further comprising webs located within the hollow interior of the tubular section.

6. The cigarette of claim 5, wherein the webs extend the entire length of the mouth section.

7. The cigarette of claim 6 wherein the webs divide the interior of the mouth section into a plurality of smoke flow channels.

8. A cigarette comprising:

a generally cylindrically shaped tobacco column;

a generally cylindrically shaped, hollow tubular mouth section located in coaxial abutment to one end of the tobacco column, the wall of the mouth section being impermeable;

a plurality of grooves formed in the periphery of the mouth section extending generally longitudinally of the tubular mouth section and being open to at least the mouth end of the mouth section;

tipping material circumferentially surrounding the mouth section and overlapping a portion of the tobacco column adjacent the mouth section, the tipping material being permeable over an area of each of the grooves;

the tobacco column comprising a first generally cylindrically shaped tobacco section interfacing with the mouth section, a second generally cylindrically shaped tobacco section in coaxial abutment with the first tobacco section, and the density of the first tobacco section being different than the density of the second tobacco section.

9. The cigarette of claim 8, wherein the first tobacco section is of a higher density than the second section.

10. The cigarette of claim 8, further comprising an impermeable wrapper material circumferentially surrounding the first tobacco section.

11. A cigarette comprising:

a generally cylindrically shaped tobacco column;

a generally cylindrically shaped, hollow tubular mouth section located in coaxial abutment to one end of the tobacco column, the wall of the mouth section being impermeable;

means defining flow channels through the mouth section;

means providing for the flow of ventilation air into some of the flow channels;

tipping material circumferentially surrounding the mouth section and overlapping a portion of the tobacco column adjacent the mouth section, the tipping material being permeable to provide for the flow of ventilating air therethrough and through the ventilation air flow means into the smoke flow channels; and, the tobacco column comprising a first generally cylindrically shaped tobacco section interfacing with the mouth section, a second generally cylindrically shaped tobacco section in coaxial abutment with the first tobacco section, and the density of the first tobacco section being different than the density of the second tobacco section.

12. The cigarette of claim 11, wherein the means defining the flow channels comprises webs located within the hollow interior of the mouth section.

13. The cigarette of claim 12, wherein the webs extend substantially the entire length of the mouth section.

14. The cigarette of claim 1, wherein:

the smoke flow channel defining means defines a central flow channel and a plurality of flow channels located in an array around the outside of the central channel; and, the ventilation air to flow into only the channels outside the central channel.

15. The cigarette of claim 11, wherein the first tobacco section is of a higher density than the second section.

16. The cigarette of claim 15, further comprising an impermeable wrapper material circumferentially surrounding the first tobacco section.

* * * * *

UNITED STATES PATENT AND TRADEMARK OFFICE

CERTIFICATE OF CORRECTION

PATENT NO. : 4,646,762

DATED : March 3, 1987

INVENTOR(S) : T. F. Riehl/R. R. Johnson

It is certified that error appears in the above—identified patent and that said Letters Patent is hereby corrected as shown below:

In the Abstract, in the third sentence, after "mouth end of the mouth section," insert the phrase ---, the grooves are organized into a plurality of groups, each group including a plurality of grooves---;

In the Abstract, in the last sentence, after "adjacent the mouth section" delete", the grooves are organized into a plurality of groups, each group including a plurality of grooves", In Column 4, line 68, change "12" to ---212";

In claim 14, line 1, delete "1" insert ---11---.

Signed and Sealed this

Eighth Day of December, 1987

*Attest:*

DONALD J. QUIGG

*Attesting Officer*

*Commissioner of Patents and Trademarks*